United States Patent [19]

Cope

[11] 3,992,883

[45] Nov. 23, 1976

[54] FAN DRIVE SYSTEMS

[75] Inventor: Raymond Cope, Birmingham, England

[73] Assignee: Lucas Industries Limited, England

[22] Filed: Oct. 1, 1975

[21] Appl. No.: 618,532

[52] U.S. Cl. ..... 60/456; 60/484; 60/494; 60/DIG. 5

[51] Int. Cl.[2] ..... F15B 11/20

[58] Field of Search ..... 60/329, 444, 456, 459, 60/484, 494, DIG. 5

[56] References Cited

UNITED STATES PATENTS

| | | | |
|---|---|---|---|
| 2,769,394 | 11/1956 | Lauck | 60/329 X |
| 3,348,624 | 10/1967 | Just et al. | 60/484 X |
| 3,874,173 | 4/1975 | Wilkins | 60/484 X |

*Primary Examiner*—Edgar W. Geoghegan
*Attorney, Agent, or Firm*—Ladas, Parry, Von Gehr, Goldsmith & Deschamps

[57] ABSTRACT

A fan drive system comprises a constant pressure ring main circuit from a motor driven pump to, for example, three variable capacity motors driving three fans. The motors are connected in parallel with each other and in series circuit with the pump and each has a piston and cylinder device supplied with pressure from the ring main. A variable restrictor controlled by a temperature probe sets the pressure acting on each piston and cylinder device so that each fan is speed controlled in accordance with temperature.

2 Claims, 1 Drawing Figure

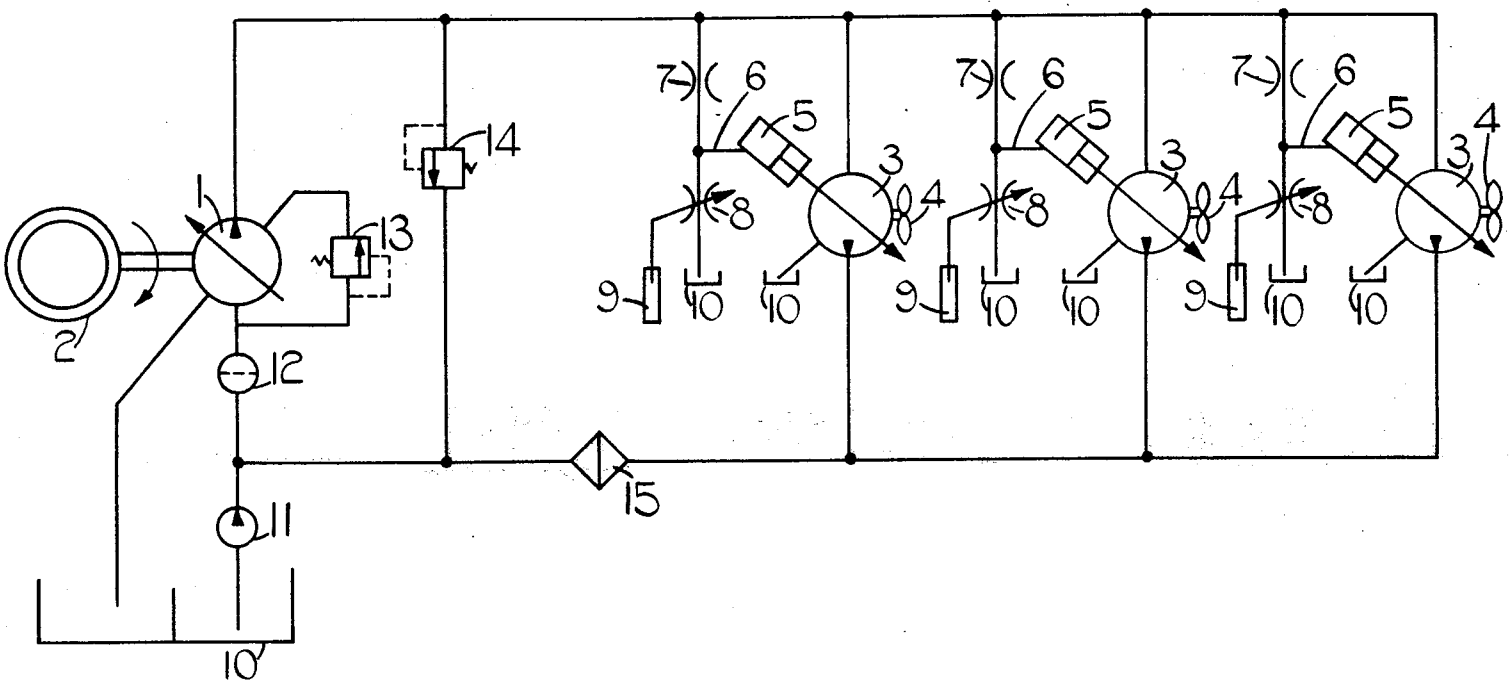
1
2
3
4
5
6
7
8
9
10
11
12
13
14
15

FAN DRIVE SYSTEMS

This invention relates to fan drive systems.

According to the present invention, there is provided a fan drive system comprising a fluid pump, a plurality of fluid motors for driving a plurality of fans, said fluid motors being of variable capacity and being connected in parallel with each other and in series, constant pressure circuit with the pump, and temperature sensitive means operably associated with each of the motors for controlling the speed of rotation of the motor by varying the capacity thereof whereby, in use, the speed of rotation of each fan can be varied separately in accordance with temperature.

Preferably, each temperature sensitive means comprises a temperature probe adapted to control the restriction of a variable orifice, the variable orifice being disposed in parallel circuit with its associated motor, there being a fixed orifice on the high pressure side of the variable orifice and a tapping between the two orifices for fluid supply to the control of the variable capacity motor.

An embodiment of the present invention will now be described, by way of example, with reference to the accompanying drawing which is a circuit diagram of a fan drive system according to the present invention.

The fan drive system is basically a constant pressure ring main circuit from a single pump 1 driven by a prime mover 2 to, in this example, three variable capacity motors 3 driving three fans 4. The motors 3 are arranged in parallel with each other and in a series circuit with the pump 1 and each is provided with a conventional piston and cylinder device 5 for varying its capacity. Each piston and cylinder device 5 is supplied with fluid through a tapping 6 disposed between a fixed orifice 7 and a variable orifice 8, the orifices 7 and 8 being disposed in parallel with their associated motors 3. Each variable orifice 8 is controlled by a temperature probe 9 disposed at a location where it is desired to provide ventilation in accordance with temperature. The pump 1 is supplied with hydraulic fluid from a reservoir 10 via a boost pump 11 and a filter 12 is incorporated into the ring main circuit. Also provided are a pair of relief valves 13 and 14 for maintaining constant pressure in the system. A cooler 15 is incorporated in the return circuit to the pump 1.

Since the circuit is a constant pressure circuit, the speed of the fans 4 can be varied separately by varying the torque available at the motor shaft, thus the speed of the motor 3 will increase as its capacity is decreased and vice versa. The capacity of each motor 3 is varied, as noted above, by the piston and cylinder device 5 the pressure to which is varied by varying the restriction of the variable orifice 8 which controls the flow of hydraulic fluid to the reservoir 10. In this manner, the temperature probe 9 varies the restriction of variable orifice 8 in accordance with temperature and thereby varies the speed of the fan 4 in accordance with temperature separately for each fan and temperature probe assembly.

The above described arrangement has the advantage that, providing the flow capacity is available, it is possible to run an unlimited number of fans from one power source. Furthermore, because the control is on the fan motor, the distance over which temperature signals have to be transmitted is shorter than on a conventional system. The above system also has the advantage that, by varying the pressure at which the system operates and the maximum motor capacity, it is possible to provide the exact input requirements for any fan instead of arriving at a compromise which is the case where a fixed displacement motor system is employed. Lastly, the use of a pressure-compensated pump which automatically stalls off to give only that flow which is required by the system at any time enables the fan drive power requirements to be kept to a minimum.

I claim:

1. A fan drive system comprising a fluid pump, a plurality of fluid motors for driving a plurality of fans, said fluid motors being of variable capacity and being connected in parallel with each other and in a series, constant pressure circuit with the pump, and temperature sensitive means operably associated with each of the motors for controlling the speed of rotation of the respective motor by varying the capacity thereof whereby, in use, the speed of rotation of each fan can be varied separately in accordance with temperature, each temperature sensitive means comprising a temperature sensitive probe arranged to control the restriction of a variable orifice, the variable orifice being disposed in parallel circuit with its associated motor, there being a fixed orifice on the high pressure side of the variable orifice and a tapping between the two orifices for fluid supply to the control of the variable capacity motor.

2. The system according to claim 1, wherein each temperature sensitive means comprises a temperature sensitive probe arranged to control the restriction of a variable orifice which is disposed to affect fluid supply to means for varying the capacity of the respective motor.

* * * * *